US005271249A

United States Patent [19]

Mitsumoto et al.

[11] Patent Number: 5,271,249

[45] Date of Patent: Dec. 21, 1993

[54] METHOD OF KNITTING TUBULAR KNIT FABRICS

[75] Inventors: Shigenobu Mitsumoto; Masao Okuno, both of Wakayama, Japan

[73] Assignee: Shima Seiki Mfg., Ltd., Wakayama, Japan

[21] Appl. No.: 856,960

[22] PCT Filed: Sep. 19, 1991

[86] PCT No.: PCT/JP91/01246

§ 371 Date: May 15, 1992

§ 102(e) Date: May 15, 1992

[87] PCT Pub. No.: WO92/05304

PCT Pub. Date: Apr. 2, 1992

[30] Foreign Application Priority Data

Sep. 19, 1990 [JP] Japan ..... 2-251148

[51] Int. Cl.[5] ..... D04B 1/24

[52] U.S. Cl. ..... 66/60 R; 66/172 R; 66/176

[58] Field of Search ..... 66/70, 60 R, 176, 172 R

[56] References Cited

U.S. PATENT DOCUMENTS

| | | | |
|---|---|---|---|
| 3,474,643 | 10/1969 | Robinson et al. | 66/176 |
| 3,668,898 | 6/1972 | Betts et al. | 66/176 X |
| 3,796,068 | 3/1974 | Betts et al. | 66/176 |
| 3,808,841 | 5/1974 | Betts et al. | 66/172 R |
| 3,875,768 | 4/1975 | Arndt | 66/172 R |
| 4,048,819 | 9/1977 | Johnson | 66/176 X |
| 4,095,441 | 6/1978 | Robinson et al. | 66/176 |
| 4,111,008 | 9/1978 | Robinson et al. | 66/176 |
| 4,793,034 | 12/1988 | Poloff et al. | 66/176 X |

*Primary Examiner*—Clifford D. Crowder
*Assistant Examiner*—John J. Calvert
*Attorney, Agent, or Firm*—Edwin E. Greigg; Ronald E. Greigg

[57] ABSTRACT

A flat knitting machine provided with at least a pair of needle beds, either or both of the needle beds arranged for movement lengthwisely thereof. Two tubular knit fabrics being coupled each other at both ends, are provided in linear symmetrical relationship about a boundary line of adjointed ends. Two loops at the joint portion of each tubular fabrics are jointed, overlapping the new loop on the first overlapped loop. The method incorporates by repeating a predetermined number of times of a process of binding off the new loops, the cast-on of each tubular knit fabric is controlled so that the seams. Of the two tubular knit fabrics can be knitted in the same course.

1 Claim, 18 Drawing Sheets

Fig.3

- a miss of a front fabric
- a miss of a back fabric
- a plating yarn front stitch tuck of a front fabric
- a plating yarn back stitch tuck of a back fabric
- knitting of a front stitch of a front fabric
- knitting of a back stitch of a back fabric
- a plating yarn back stitch tuck of a front fabric
- a plating yarn back stitch tuck of a back fabric
- double front stitches of a front fabric on a front fabric
- double back stitches of a back fabric on a front fabric
- double front stitches of a back fabric on a front fabric
- double front stitches of a front fabric with a front fabric on a front stitch of a front fabric
- double front stitches of a back fabric with a back fabric on a front stitch of a back fabric
- feeder F
- feeder B
- transferring of a loop of the forward fixed needle bed to a knitting needle of the rear moving needle bed
- transferring of a loop of the rear moving needle bed to a knitting needle of the forward fixed needle bed

Fig.4-1

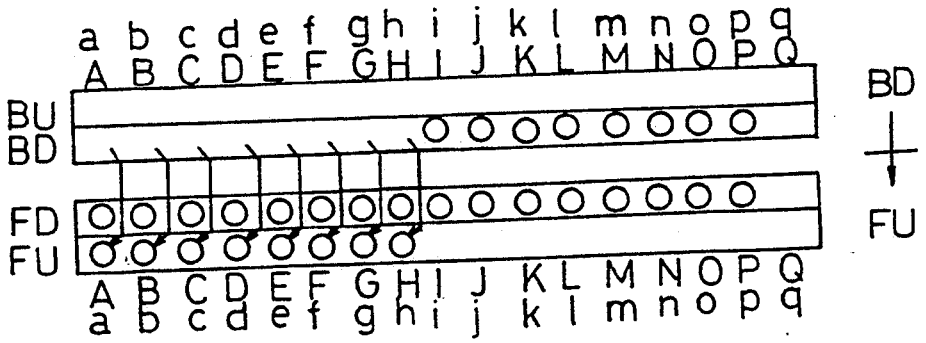

METHOD OF KNITTING TUBULAR KNIT FABRICS

TECHNICAL FIELD

The present invention relates to a method for knitting two adjoined tubular knit fabrics, e.g. neck and body or cuff and sleeve portions of a turtle-neck pullover garment, and its knitted form.

BACKGROUND ART

For example, a ribbed turtle-neck portion of tubular shape having a given diameter and a given length and a body portion of tubular shape are joined each other by a linking or sewing means, e.g. a sewing machine, for producing a tubular knit wear (or whole garment) such as a pullover, sweater, or the like.

DISCLOSURE OF THE INVENTION

The procedure of joining a neck or cuff portion to a body or sleeve portion by sewing involves picking up each stitch for joining two portions thus requiring an awkward job. This causes a declination in the productivity and also, results in drop-off of stitches.

When the two tubular knit fabrics are joined by sewing with a sewing machine, the seam between the two portions becomes increased in thickness because their edges are overlapped for joining. As the result, a finished garment will appear distinctive along the seam and give less comfortable touch in use.

Also, the extra procedure of linking or sewing with a sewing machine is needed thus lowering the productive efficiency and increasing the overall cost of fabrication of knitted garments.

The present invention is directed, in view of the foregoing points, towards a method of knitting two tubular knit fabrics to be coupled and simultaneously, joining the same at adjacent ends and also, a knit garment knitted by the method.

For achievement of the above object, a method of knitting two adjoined tubular knit fabrics according to the present invention, each tubular knit fabric consisting of a front piece and a back piece coupled to each other at both adjacent ends, is provided for use with a flat knitting machine provided with at least a pair of front and rear needle beds, either or both of the needle beds being arranged for movement lengthwisely thereof. The method incorporates repeating a predetermined number of times a front piece joining step and a back piece joining step alternately or continuously depending on the number of loops to be joined. In particular, the front piece joining step comprises overlapping a loop of the front piece of one of the two tubular knit fabrics with a loop of the front piece of the other tubular knit fabric which is facing the other loop in linear symmetrical relationship about a boundary line inbetween, forming a new loop on the overlapped loops, then, overlapping the new loop with two other front piece loops of their respective two tubular knit fabrics arranged next to the first overlapped loops, forming another new loop on the second overlapped loops, and overlapping the new loop with two further front piece loops of their respective two tubular knit fabrics arranged next to the second overlapped loops. Similarly, the back piece joining step comprises overlapping a loop of the back piece of one of the two tubular knit fabrics with a loop of the back piece of the other tubular knit fabric which is facing the other loop in linear symmetrical relationship about a boundary line in between, forming a new loop on the overlapped loops, then, overlapping the new loop with two other back piece loops of their respective two tubular knit fabrics arranged next to the first overlapped loops, forming another new loop on the second overlapped loops, and overlapping the new loop with two further back piece loops of their respective two tubular knit fabrics arranged next to the second overlapped loops. Also, a tubular knitted fabric according to the present invention, which comprises a front portion and a back portion coupled to each other at adjacent ends and fabricated with the use of a given number of knitting needles arranged on at least a pair of front and rear needle beds, either or both of the needle beds being arranged for leftward and rightward movement, lengthwisely of the same, is characterized in that the front portion consists of two front pieces coupled by matching two, inside and outside, chains of edge loops of the front pieces and then, binding off the same and the back portion consists of two back pieces coupled by matching two, inside and outside, chains of edge loops of the back pieces and then, binding off the same.

In operation, two tubular knit fabrics having a front piece and a back piece coupled to each other at adjacent ends are knitted with a flat knitting machine provided with at least a pair of front and rear needle beds, either or both of the needle beds being arranged for leftward and rightward movement.

Preferably, the cast-on of each tubular knit fabric is controlled so that the seams of the two tubular knit fabrics can be knitted in the same course.

When the two tubular knit fabrics are knitted up to the seam edges, a loop of the front piece of one of them, referred to as a moving side tubular fabric, is overlapped with a loop of the front piece of the other, referred to as a stationary side tubular knit fabric, which is facing the other loop in linear symmetrical relationship about a boundary line inbetween. Then, a new loop is formed on the two overlapped loops.

The new loop is now overlapped with two other front piece loops of their respective two, moving and stationary side, tubular knit fabrics arranged next to the first two overlapped loops. Another new loop is then formed on the second overlapped loops and overlapped with two further front piece loops of their respective two tubular knit fabrics arranged next to the second overlapped loops. This front piece joining procedure and a similar back piece joining procedure are repeated a predetermined number of times alternately or continuously depending on the number of loops to be joined so that the two tubular fabrics can be coupled to each other in tubular form.

In the end, the loop end of the seam between the two fabrics is knotted up for prevention of unraveling.

The knit garment finished through the front and back piece joining steps will exhibit its cast-on stitches arranged at both ends neatly.

The two tubular knit fabrics may be joined to each other by moving both crosswise rather than moving one moving side while the other one remains stationary.

BRIEF DESCRIPTION OF THE DRAWINGS

The accompanying drawings illustrate a method of knitting two adjoined tubular knit fabrics of one embodiment of the present invention and its knitted form, in which:

FIGS. 2-1 to 2-20 are explanatory views showing a procedure of knitting the seam between a turtle-neck portion and a body portion of the pullover;

FIG. 3 is an explanatory list showing symbols used in the procedure;

FIGS. 4-1 to 4-35 are explanatory views showing a procedure of knitting the seam between the turtle-neck portion and the body portion;

FIGS. 5-1 to 5-3 are explanatory views showing a procedure of processing the end of a yarn after completion of the knitting operation;

FIG. 6 is a schematic view showing the knitted arrangement of yarn; and

FIG. 7 is a partially enlarged view of FIG. 6.

BEST MODE FOR CARRYING OUT THE INVENTION

Figure 1:
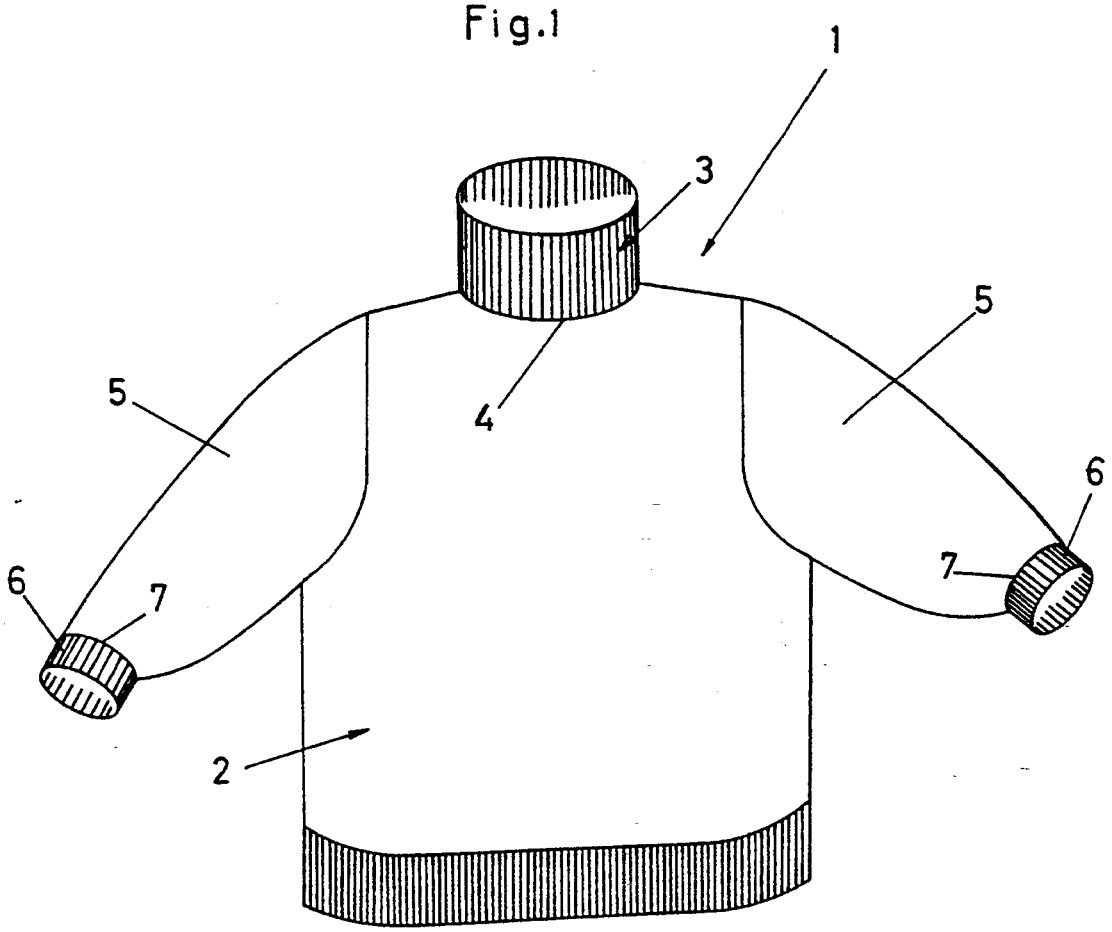
FIG. 1 is a front view of a turtle-neck pullover knitted by the method of the present invention.

One embodiment of the present invention will be described referring to the accompanying drawings The present invention provides a method of knitting two adjoined tubular knit fabrics and a tubular knitted fabric joined at both ends by knitting, and is embodied in the form of knitting a joint 4 between a body portion 2 and a turtle-neck portion 3 of a turtle-neck pullover 1 or a joint 7 between a sleeve portion 5 and a cuff portion 6 of the same. Preferably, the embodiment of the present invention is carried out using such a knitting machine as disclosed in Japanese Patent Laid-open Publication 64-68547 (1989). The preferred knitting machine is a flat knitting machine having an extra pair of front and rear needle beds provided above two, front and rear, main needle beds which are arranged facing each other and in an inverted-V form when viewed from the side. Each of the needle beds has a multiplicity of knitting needles mounted thereto for forward and backward sliding movement. Also, the two rear ones of the four needle beds can travel leftward and rightward.

Figures 1, 2:
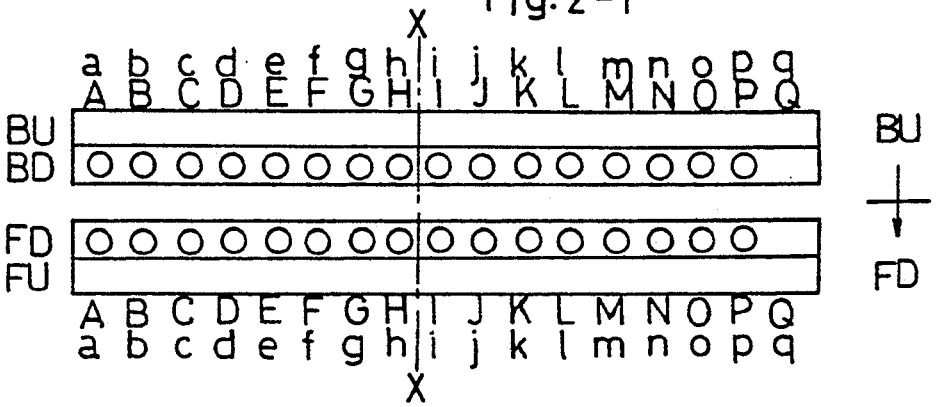
Figure 2:
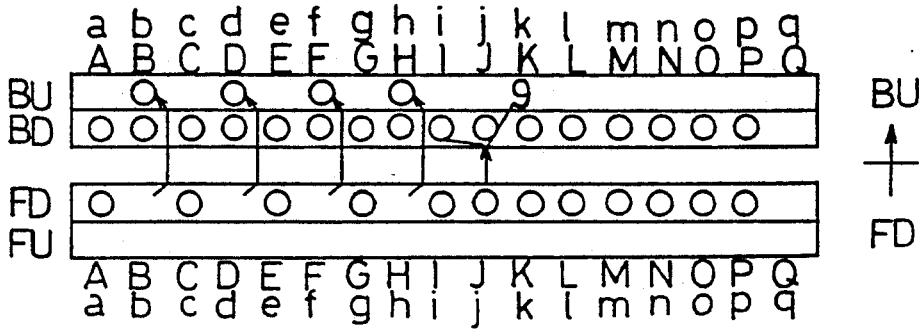
Figures 2, 3:
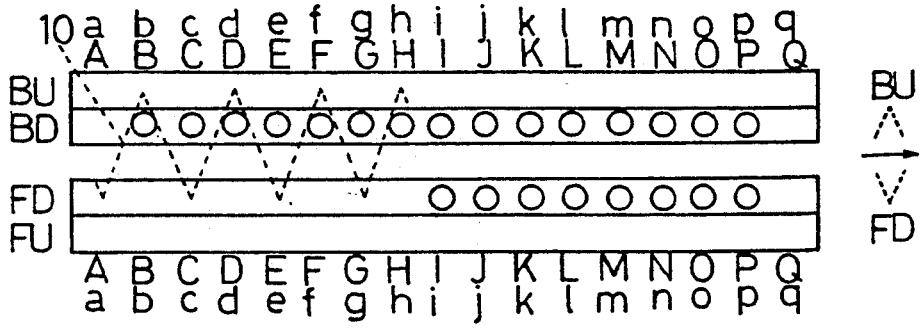
Figures 2, 3, 4:
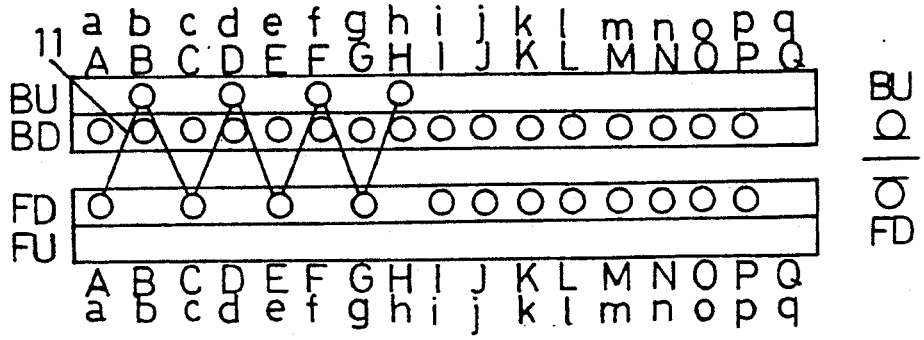

FIGS. 2 and 4 show a series of courses for knitting the body 2 and turtle-neck portion 3 of the pullover 1 up to joining them together. In addition to the symbols listed in FIG. 3, the alphabetic capital letters A to X illustrated in FIGS. 2 and 4 represent the knitting needles of the lower needle beds and the small letters a to x are the knitting needles of the upper needle beds. Also, as explained in the Publication 64-68547, denoted by FU is the upper front needle bed, FD the lower front needle bed, BU the upper rear needle bed, and BD the lower rear needle bed. The letter P accompanied with a numeral and shown at upper right in FIG. 4 represents a racking (movement) of the rear needle beds from the original position in FIG. 2.

The courses shown in FIGS. 2-1 to 2-20 illustrate a procedure of knitting a close-to-joint region of the turtle-neck portion 3 and the courses from FIG. 4-1 to FIG. 4-35 show a procedure of knitting the joint 4.

As shown in FIG. 2-1, the turtle-neck portion 3 is knitted with the two, front and rear, lower needle beds on the left side of the center one-dot chain line X—X (a boundary) of the knitting machine and on the right side, the body portion 2 is knitted with the two, front and rear, lower needle beds.

More particularly, two, front and back, pieces of the turtle-neck portion 3 are knitted at the left half of the machine by the lower front FD and the lower rear needle bed BD respectively. Also, both ends of each piece are joined to those of the other piece by knitting, as shown in FIG. 6, thus forming a tubular shape. Similarly, the front and back pieces of the body portion 2 are knitted at the right half by the lower front FD and the lower rear needle bed BD respectively.

For rib knitting of the front piece of the turtle-neck portion 3, a carrier 9 which feeds a yarn to the rear lower needle bed BD for knitting the back piece of the body portion 2 is first moved (or "kicked back") to the right of FIG. 2-2 thus not to disturb the ribbing action. Then, alternate loops of yarn hanged on B, D, F, and H of the knitting needles A to H of the lower front needle bed FD are transferred onto the corresponding knitting needles b, d, f, and h of the upper rear needle bed BU, as shown in FIG. 2-2.

At the course shown in FIG. 2-3, a plating yarn 10 is infed from an unshown carrier throughout the loops on b, d, f, and h of the upper rear needle bed BU and the remaining loops on A, C, E, and G of the lower front needle bed FD. Then, a main yarn 11 supplied from the carrier, not shown, produces a series of loops as shown in FIG. 2-4 so that the rib knitted front piece of the turtle-neck portion 3 can be fabricated by a combination of the main and plating yarns 11 and 10 denoted by IV in FIG. 6.

At the course shown in FIG. 2-5, the loops hung on b, d, f, and h of the upper rear needle bed BU are returned back to B, D, F, and H of the lower front needle bed FD for continuing to knit the back piece of the turtle-neck portion 3, thus keeping the knitting needles a to h of the upper rear needle bed BU free, like as shown in FIG. 2-1.

Accordingly, the front piece of the turtle-neck portion 3 can be rib knitted throughout the courses from FIG. 2-1 to FIG. 2-5.

Then, alternative loops hanged on A, C, E, and G of the knitting needles A to H of the lower rear needle bed BD are transferred onto the corresponding knitting needles a, c, e, and g of the upper front needle bed FU, as shown in FIG. 2-6.

At the course shown in FIG. 2-7, the plating yarn 10 is infed from an unshown carrier throughout the loops on a, c, e, and g of the upper front needle bed FU and the remaining loops on B, D, F, and H of the lower rear needle bed BD. In sequence, the main yarn 11 supplied from the carrier, not shown, produces a series of loops as shown in FIG. 2-8 so that the rib knitted back piece of the turtle-neck portion 3 can be fabricated by a combination of the main and plating yarns 11 and 10 denoted by III in FIG. 6.

At the course shown in FIG. 2-9, the loops hung on a, c, e, and g of the upper front needle bed FU are returned back to A, C, E, and G of the lower rear needle bed BD for continuing to knit the front piece of the turtle-neck portion 3, thus allowing the knitting needles a to h of the upper front needle bed FU to stay in the same free state as shown in FIGS. 2-1 and 2-5.

Accordingly, the back piece of the turtle-neck portion 3 can be rib knitted throughout the courses from FIG. 2-6 to FIG. 2-9.

A procedure, shown from FIG. 2-2 to 2-5, of rib knitting the front piece of the turtle-neck portion 3 is repeated in the courses from FIG. 2-10 to FIG. 2-13 and a procedure, shown from FIG. 2-6 to 2-9, of rib knitting the back piece of the same is repeated in the courses from FIG. 2-14 to FIG. 2-17. More specifically, the two procedures of rib knitting the front and back pieces of the turtle-neck portion 3 are alternated during the ribbing operation.

When a predetermined length (from cast-on to joint end) of the turtle-neck portion 3 has been fabricated after the course shown in FIG. 2-18, the carrier 9 feeding the yarn for rib knitting of the front piece of the turtle-neck portion 3 moves out from the rib knitting area and stops as shown in FIG. 2-19.

At the course shown in FIG. 2-20, the loops hanged on b, d, f, and h of the upper rear needle bed BU are returned back to B, D, F, and H of the lower front needle bed FD.

During the cast-on operation for rib knitting the turtle-neck portion 3, the cast-on loops of the body portion 2 remain stationary on the knitting needles I to P of the two, front and rear, lower needle beds FD and BD according to the embodiment. However, both the body and turtle-neck portions 2 and 3 may be casted on simultaneously.

The plating yarn 10 used for rib knitting of the front and back pieces is an elastic thread which is intended to prevent the loops of the main yarn from stretching to an excess during the transfer between the upper and lower or front and rear needle beds in fabrication or when the finished garment is put on.

If the main yarn of the pullover 1 itself has an acceptable elasticity, the plating yarn 10 will not be needed.

FIG. 4-1 shows the transfer of loops hung on the knitting needles A to H of the lower rear needle bed BD to the corresponding knitting needles a to h of the upper front needle bed FU for knitting of loops of the body and turtle-neck portions 2, 3.

At the course shown in FIG. 4-2, loops hung on the knitting needles I to P of the lower rear needle bed BD are transferred onto the knitting needles j to q of the upper front needle bed FU after the lower rear needle bed BD is displaced by one racking pitch from the original position shown in FIG. 4-1 to the right. Then, the two rear needle beds BD and BU are moved to the left by a maximum distance of 8 racking pitches preset in the flat knitting machine.

At the time, the carriers 9 and 12 for feeding the yarn for knitting the loops of the body and turtle-neck portions 2,3 stay in the left side off the loops of the body portion 2.

At the course shown in FIG. 4-3, the loops hung on the knitting needles a to h of the upper front needle bed FU are transferred onto the knitting needles I to P of the lower rear needle bed BD after the two carriers 9 and 12 are kicked back from the left side off the loops of the body portion 2 to the right side off the loops of the turtle-neck portion 3.

Then, the loops of the turtle-neck portion 3 hung, on the knitting needles A to H of the lower front needle bed FD are transferred onto the corresponding knitting needles i to p of the upper rear needle bed BU, as shown in FIG. 4-4, thus keeping the knitting needles of the two, upper and lower, front needle beds FD and FU free.

Figures 2, 3, 4, 5:
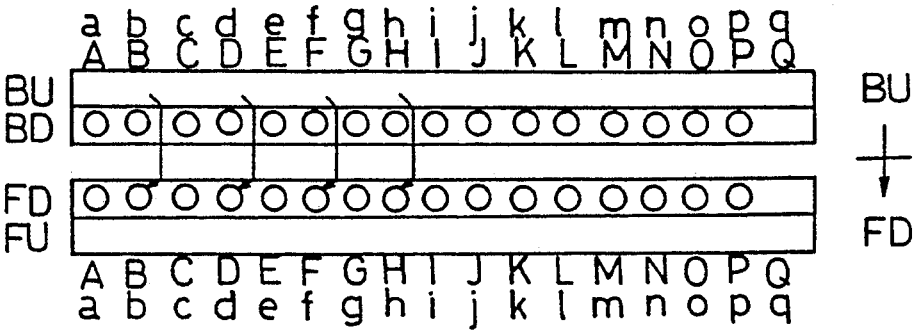
Figures 2, 3, 4, 5, 6:
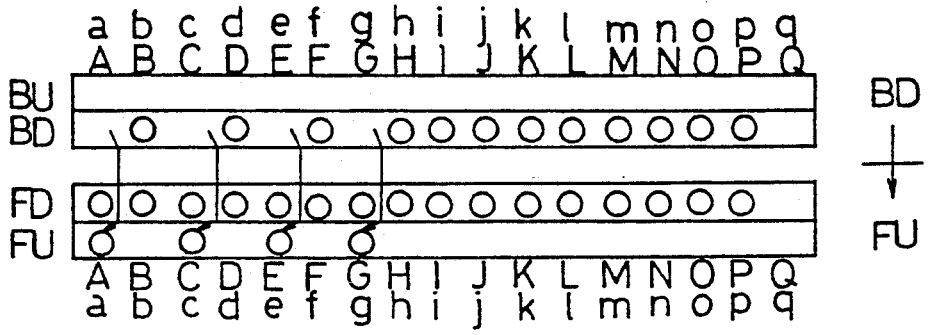
Figures 2, 3, 4, 5, 6, 7:
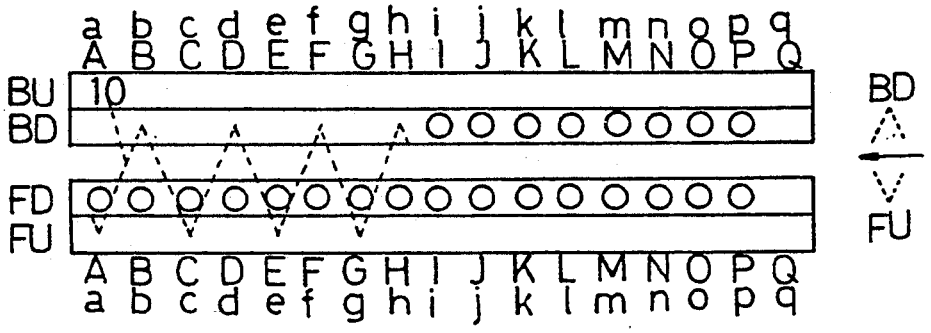
Figures 2, 3, 4, 5, 6, 7, 8:
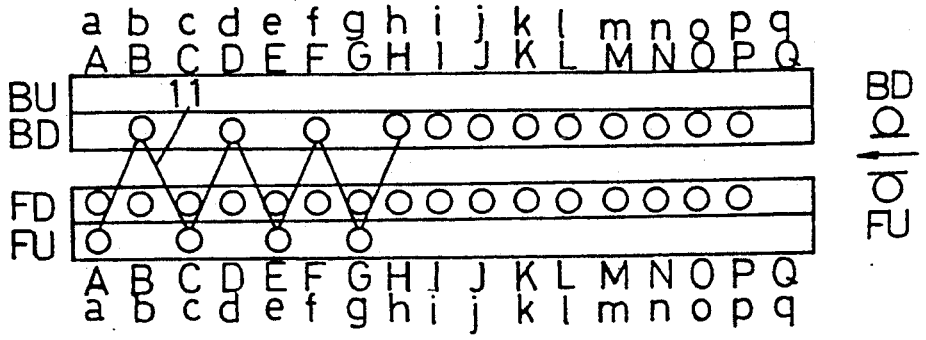
Figures 2, 3, 4, 5, 6, 7, 8, 9:
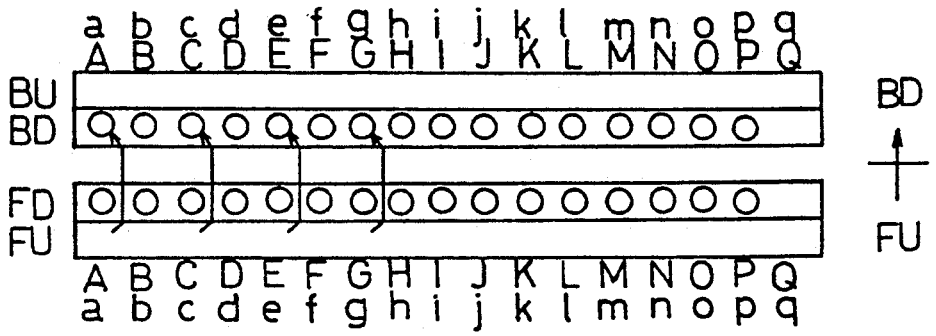
Figures 2, 3, 4, 5, 6, 7, 8, 9, 10:
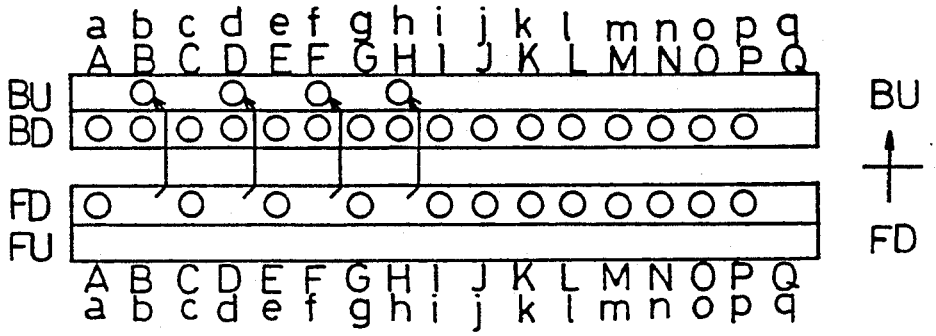
Figures 2, 3, 4, 5, 6, 7, 8, 9, 10, 11:
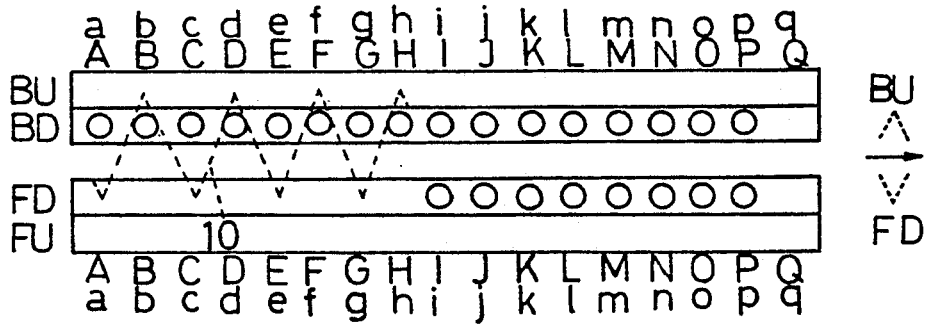
Figures 2, 3, 4, 5, 6, 7, 8, 9, 10, 11, 12:
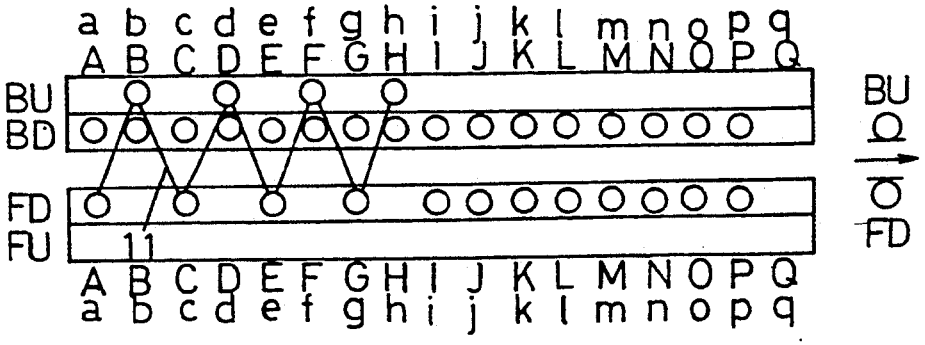
Figures 2, 3, 4, 5, 6, 7, 8, 9, 10, 11, 12, 13:
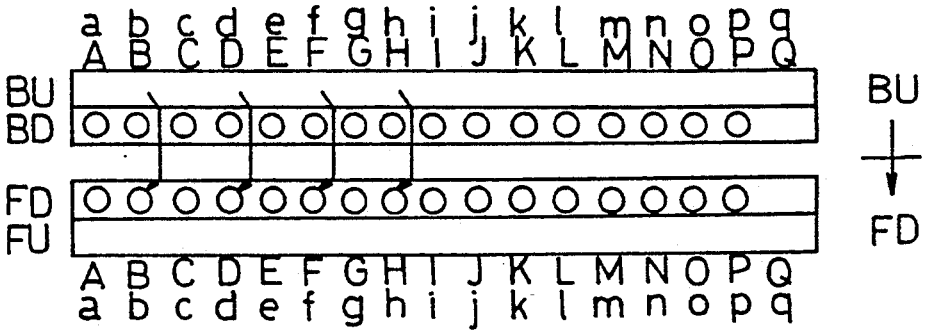
Figures 2, 3, 4, 5, 6, 7, 8, 9, 10, 11, 12, 13, 14:
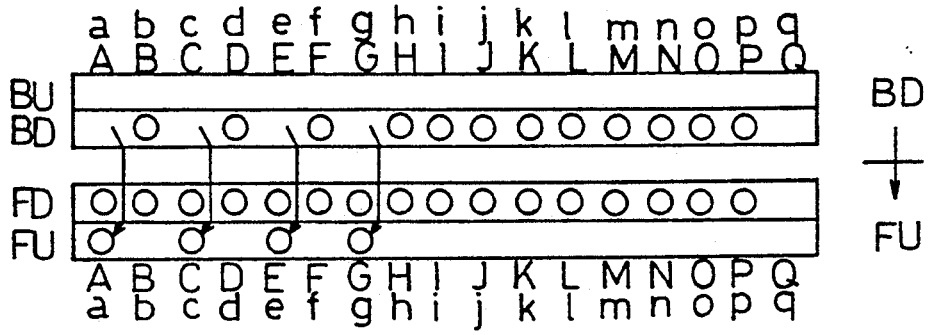
Figures 2, 3, 4, 5, 6, 7, 8, 9, 10, 11, 12, 13, 14, 15:
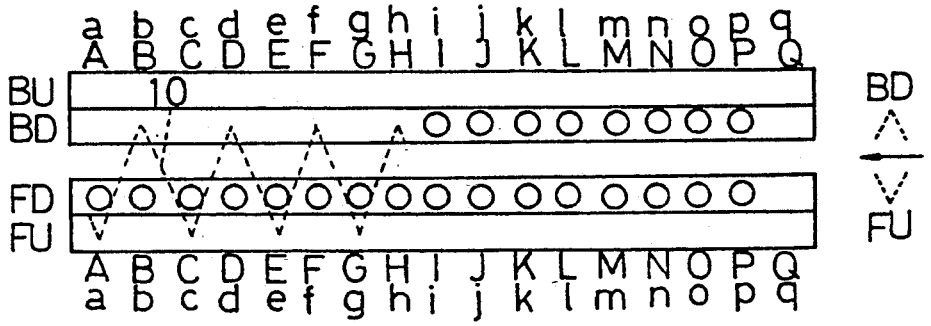
Figures 2, 3, 4, 5, 6, 7, 8, 9, 10, 11, 12, 13, 14, 15, 16:
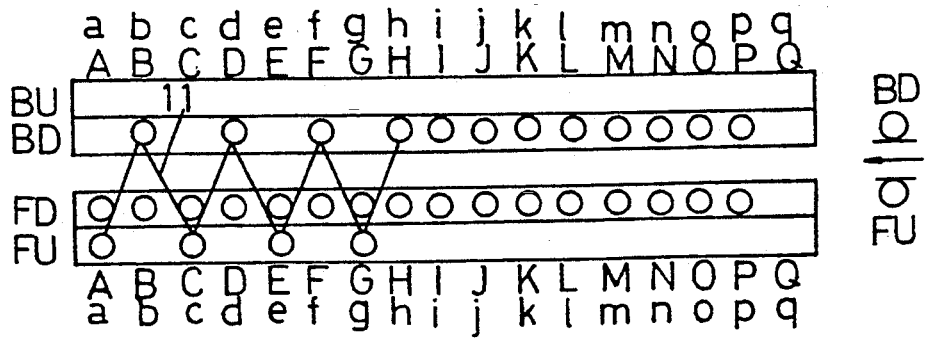
Figures 2, 3, 4, 5, 6, 7, 8, 9, 10, 11, 12, 13, 14, 15, 16, 17:
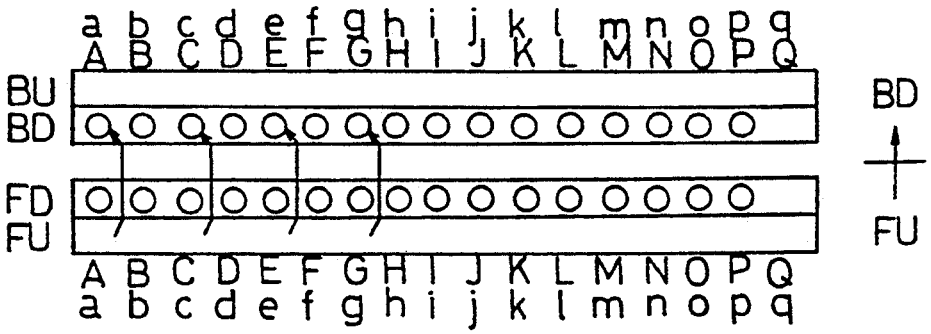
Figures 2, 3, 4, 5, 6, 7, 8, 9, 10, 11, 12, 13, 14, 15, 16, 17, 18:
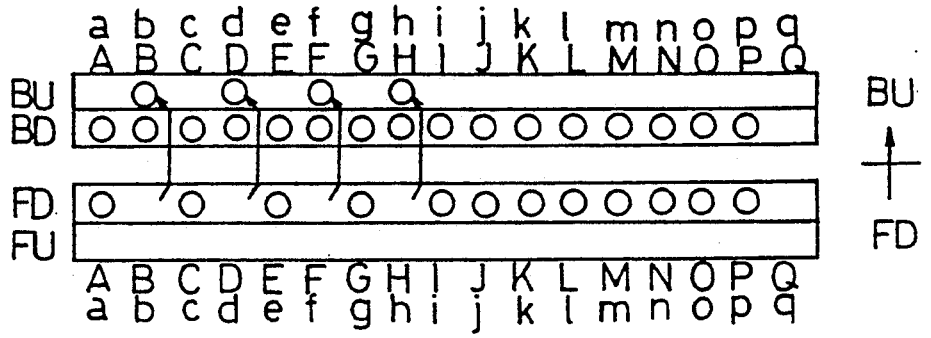
Figures 2, 3, 4, 5, 6, 7, 8, 9, 10, 11, 12, 13, 14, 15, 16, 17, 18, 19:
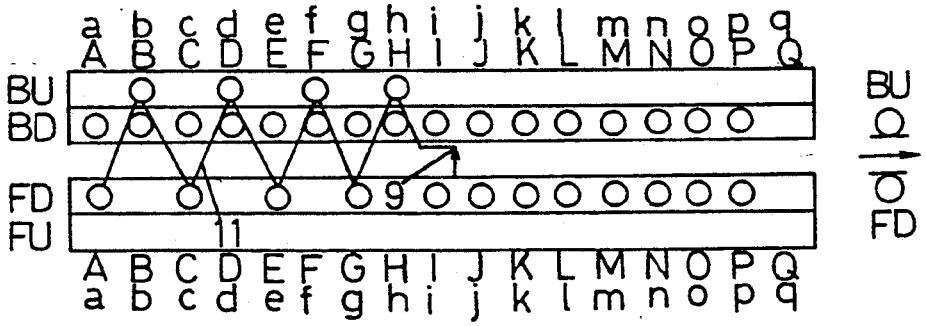
Figures 2, 3, 4, 5, 6, 7, 8, 9, 10, 11, 12, 13, 14, 15, 16, 17, 18, 19, 20:
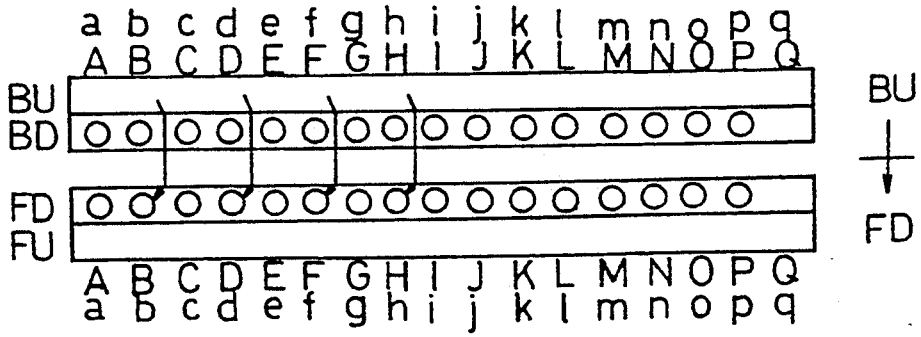
Figures 2, 4:
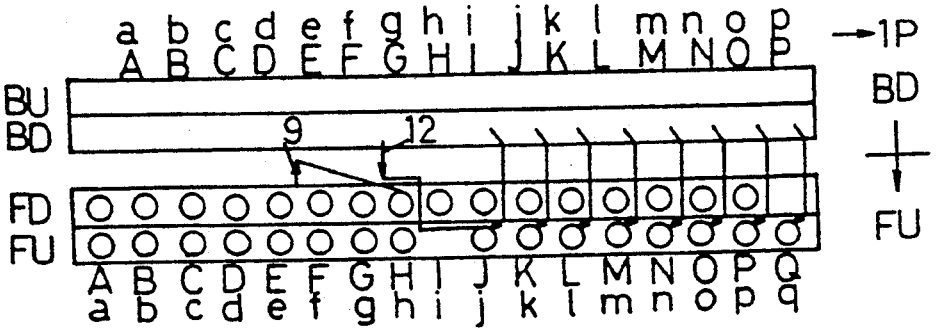
Figures 3, 4:
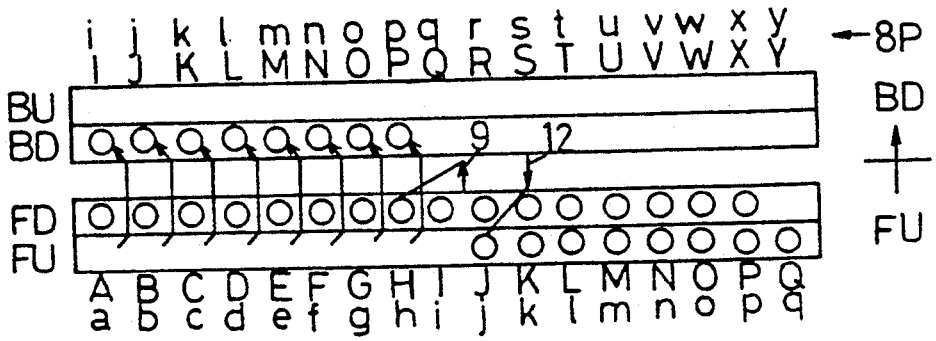
Figure 4:
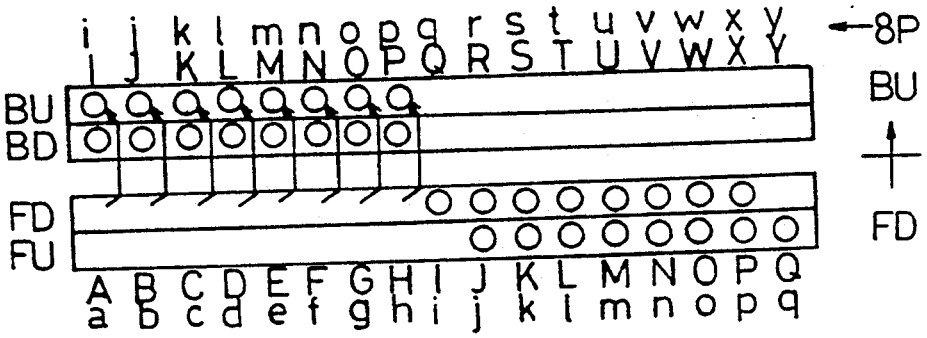
Figures 4, 5:
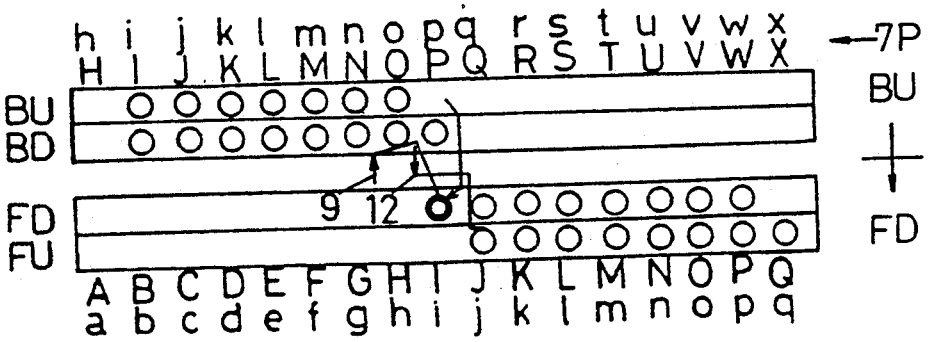
Figures 4, 5, 6:
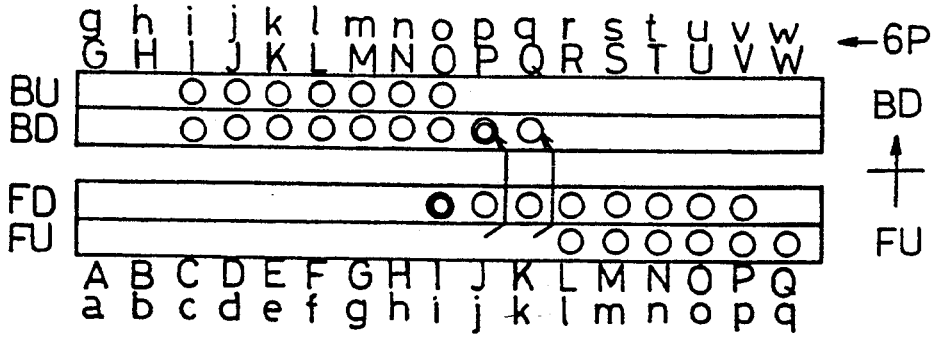
Figures 4, 5, 6, 7:
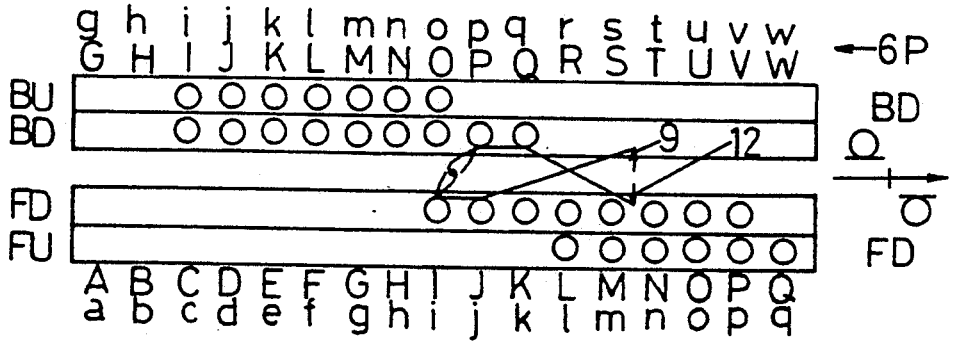
Figures 4, 5, 6, 7, 8:
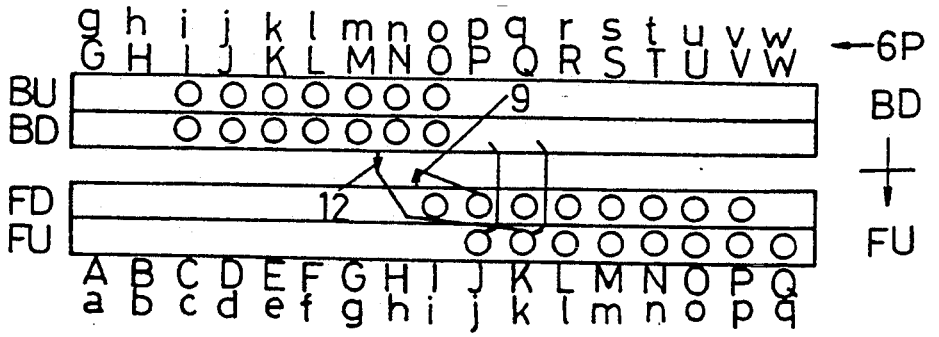
Figures 4, 5, 6, 7, 8, 9:
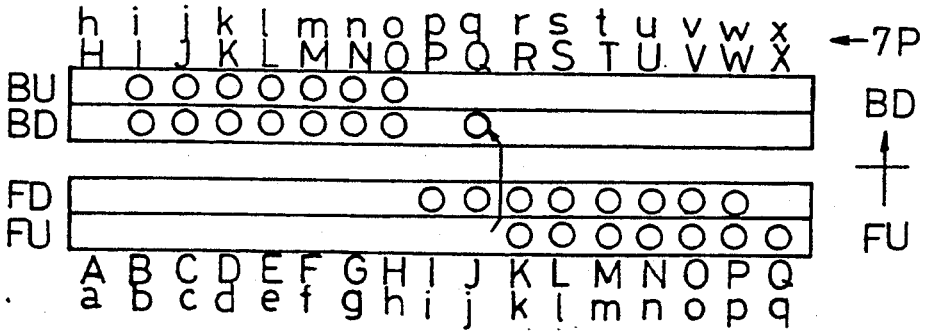
Figures 4, 5, 6, 7, 8, 9, 10:
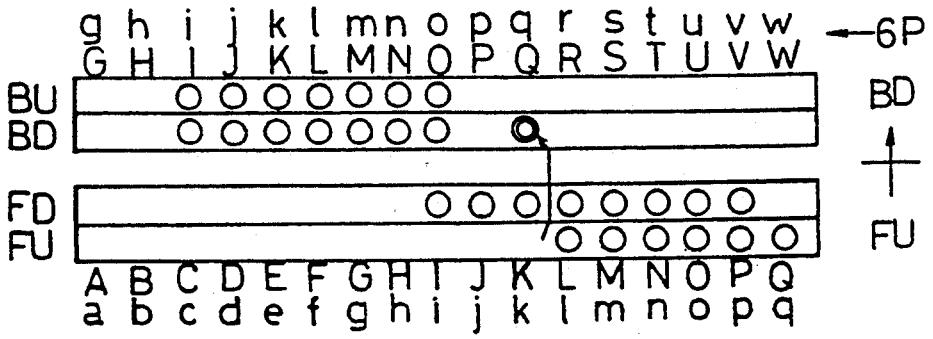
Figures 4, 5, 6, 7, 8, 9, 10, 11:
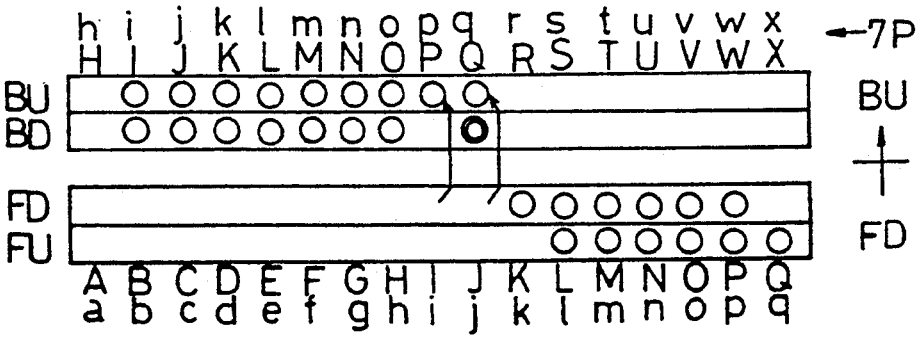
Figures 4, 5, 6, 7, 8, 9, 10, 11, 12:
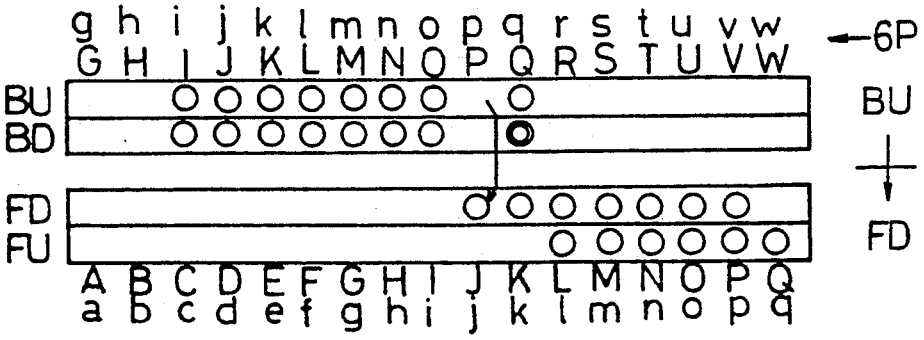
Figures 4, 5, 6, 7, 8, 9, 10, 11, 12, 13:
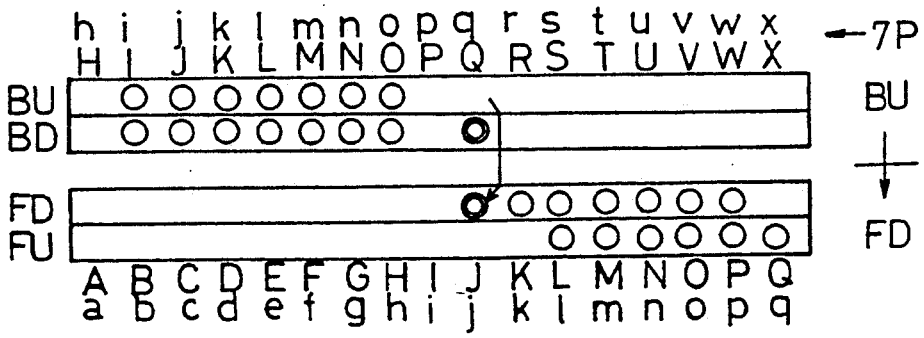
Figures 4, 5, 6, 7, 8, 9, 10, 11, 12, 13, 14:
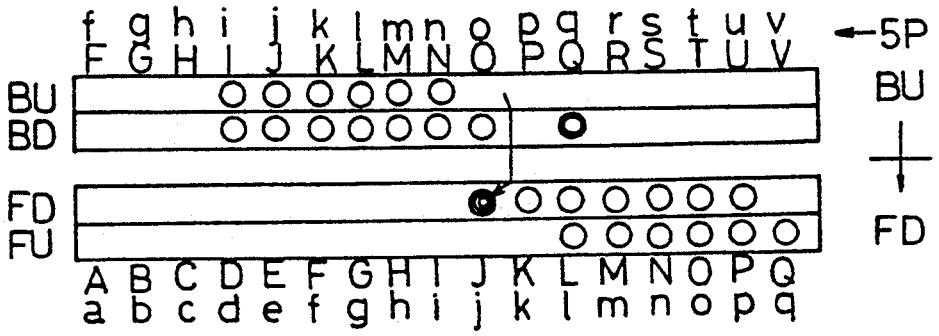
Figures 4, 5, 6, 7, 8, 9, 10, 11, 12, 13, 14, 15:
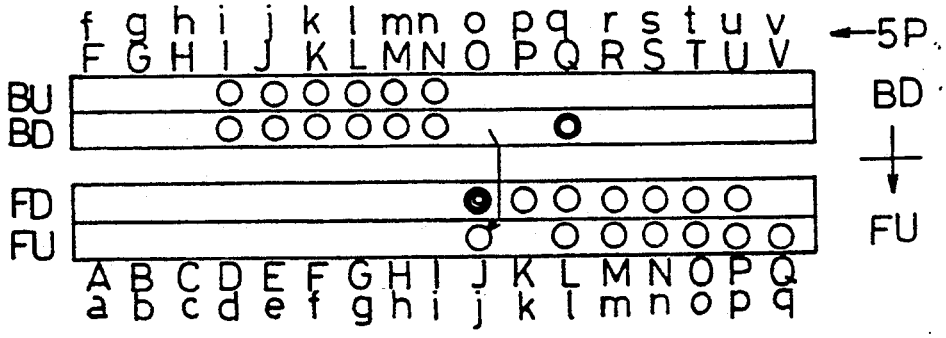
Figures 4, 5, 6, 7, 8, 9, 10, 11, 12, 13, 14, 15, 16:
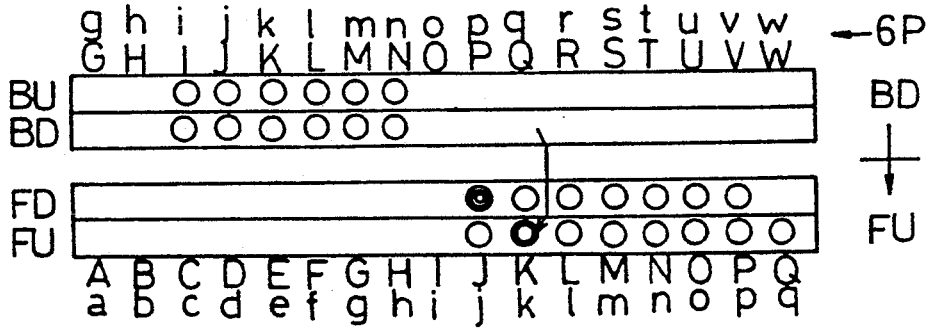
Figures 4, 5, 6, 7, 8, 9, 10, 11, 12, 13, 14, 15, 16, 17:
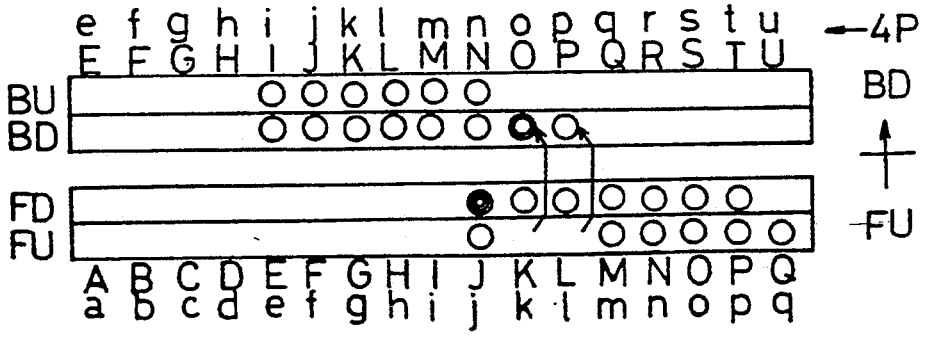
Figures 4, 5, 6, 7, 8, 9, 10, 11, 12, 13, 14, 15, 16, 17, 18:
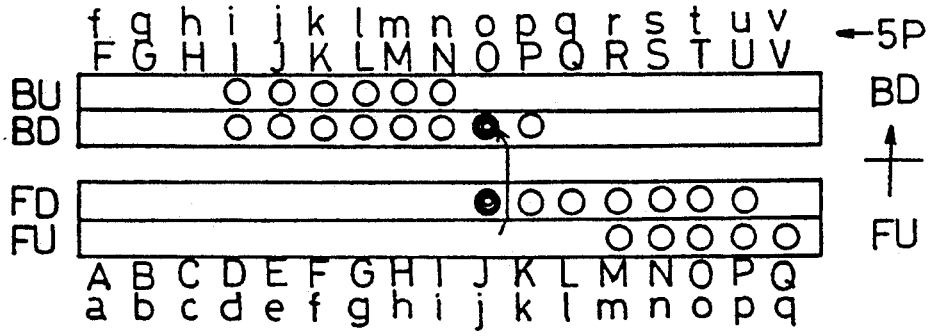
Figures 4, 5, 6, 7, 8, 9, 10, 11, 12, 13, 14, 15, 16, 17, 18, 19:
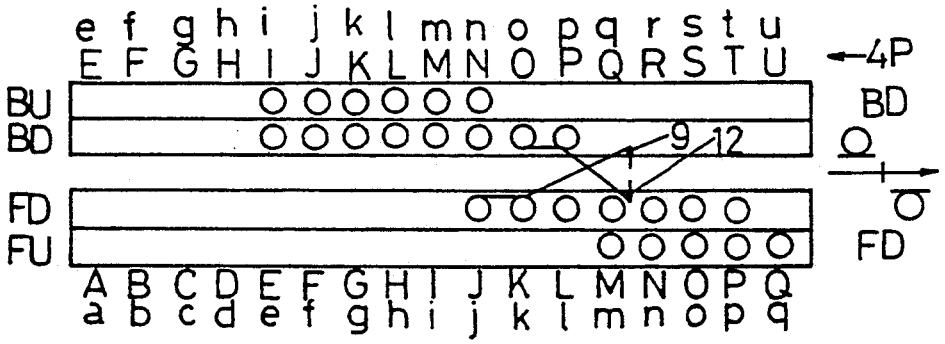
Figures 4, 5, 6, 7, 8, 9, 10, 11, 12, 13, 14, 15, 16, 17, 18, 19, 20:
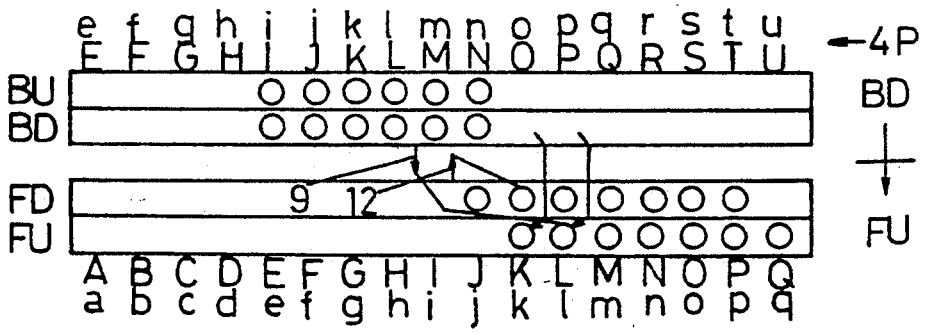
Figures 4, 5, 6, 7, 8, 9, 10, 11, 12, 13, 14, 15, 16, 17, 18, 19, 20, 21:
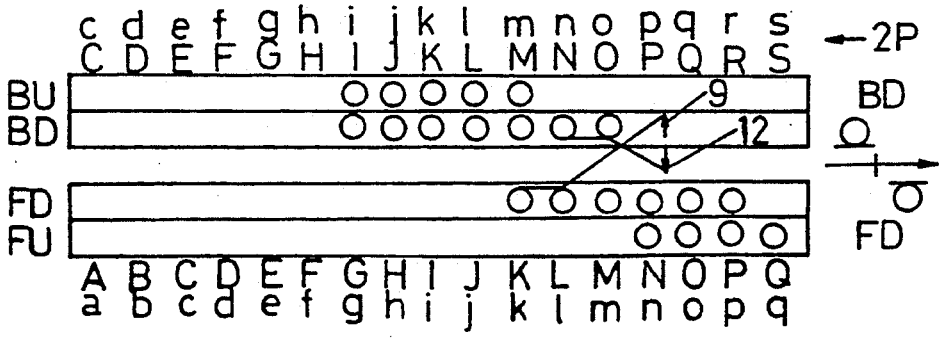
Figures 4, 5, 6, 7, 8, 9, 10, 11, 12, 13, 14, 15, 16, 17, 18, 19, 20, 21, 22:
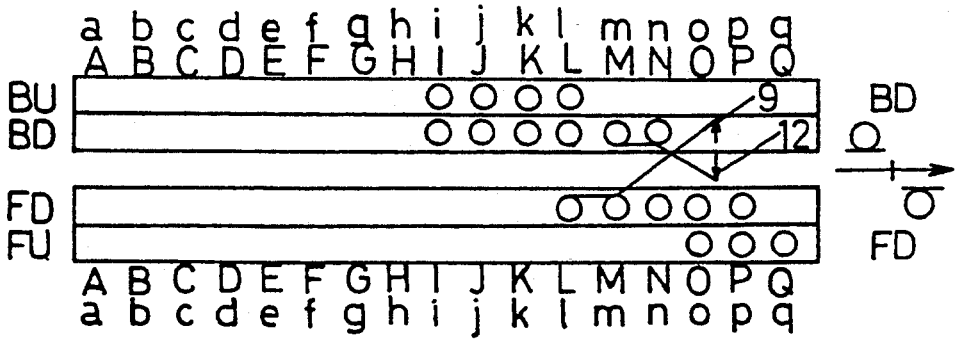
Figures 4, 5, 6, 7, 8, 9, 10, 11, 12, 13, 14, 15, 16, 17, 18, 19, 20, 21, 22, 23:
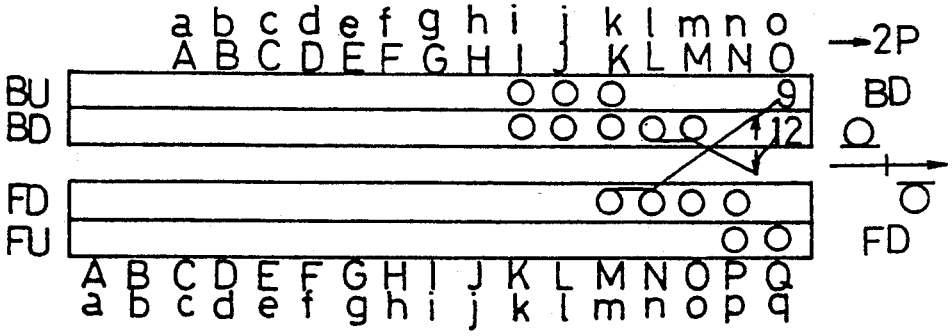
Figures 4, 5, 6, 7, 8, 9, 10, 11, 12, 13, 14, 15, 16, 17, 18, 19, 20, 21, 22, 23, 24:
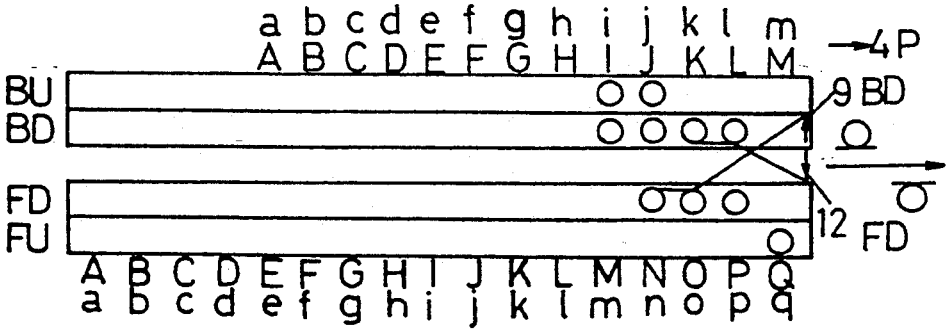
Figures 4, 5, 6, 7, 8, 9, 10, 11, 12, 13, 14, 15, 16, 17, 18, 19, 20, 21, 22, 23, 24, 25:
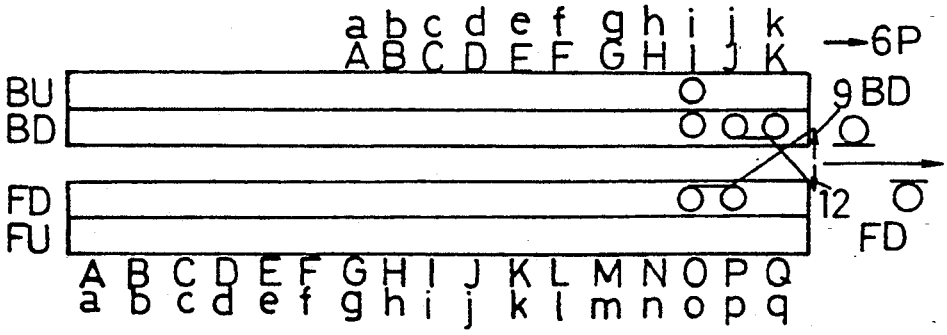
Figures 4, 5, 6, 7, 8, 9, 10, 11, 12, 13, 14, 15, 16, 17, 18, 19, 20, 21, 22, 23, 24, 25, 26:
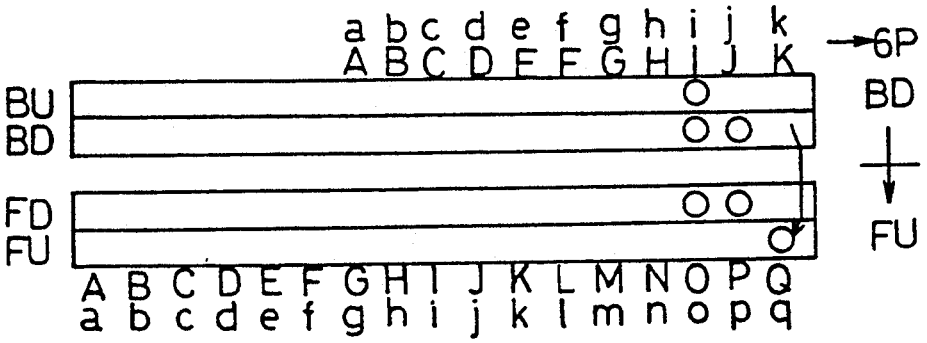
Figures 4, 5, 6, 7, 8, 9, 10, 11, 12, 13, 14, 15, 16, 17, 18, 19, 20, 21, 22, 23, 24, 25, 26, 27:
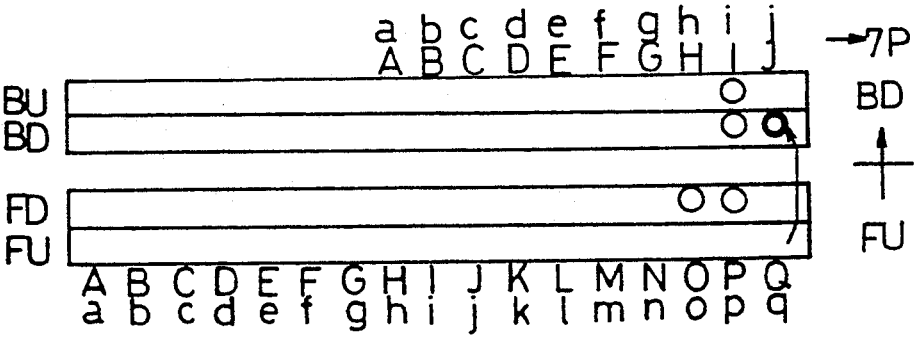
Figures 4, 5, 6, 7, 8, 9, 10, 11, 12, 13, 14, 15, 16, 17, 18, 19, 20, 21, 22, 23, 24, 25, 26, 27, 28:
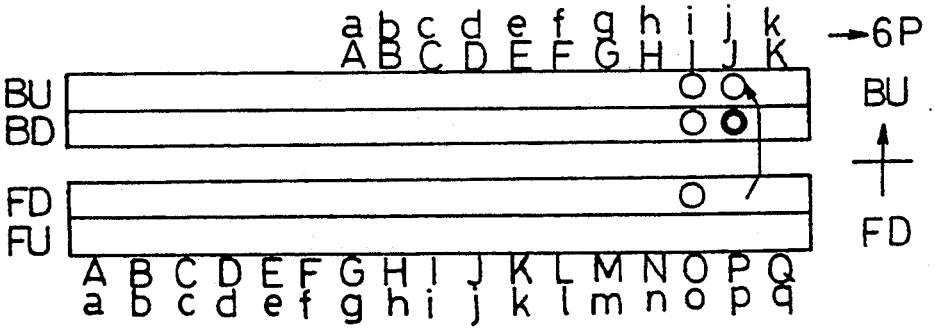
Figures 4, 5, 6, 7, 8, 9, 10, 11, 12, 13, 14, 15, 16, 17, 18, 19, 20, 21, 22, 23, 24, 25, 26, 27, 28, 29:
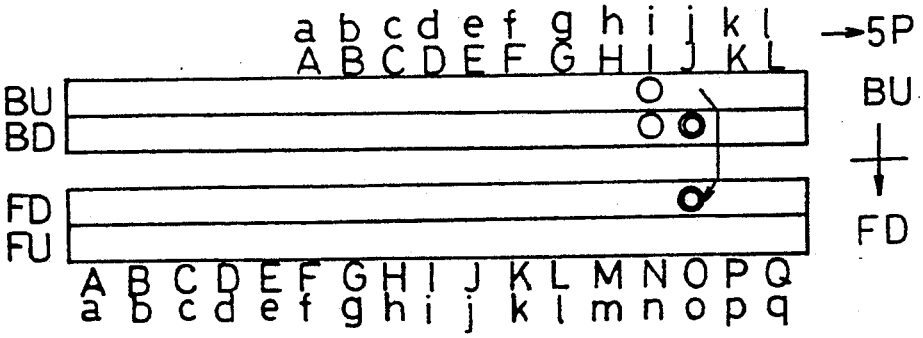
Figures 4, 5, 6, 7, 8, 9, 10, 11, 12, 13, 14, 15, 16, 17, 18, 19, 20, 21, 22, 23, 24, 25, 26, 27, 28, 29, 30:
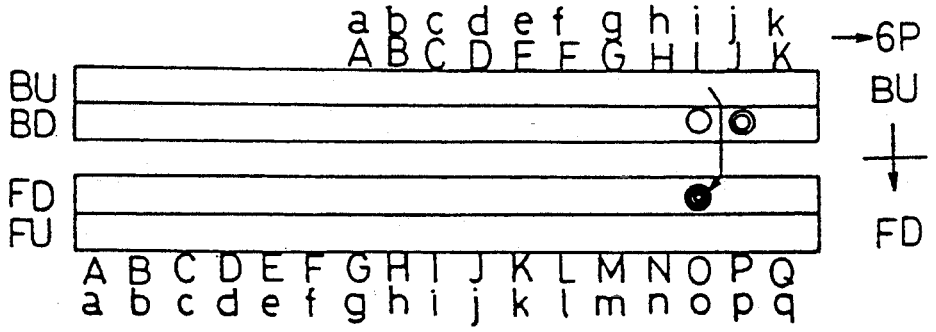
Figures 4, 5, 6, 7, 8, 9, 10, 11, 12, 13, 14, 15, 16, 17, 18, 19, 20, 21, 22, 23, 24, 25, 26, 27, 28, 29, 30, 31:
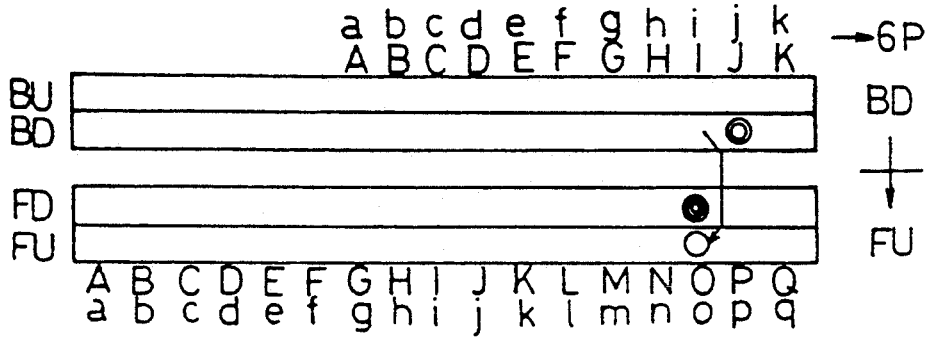
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32:
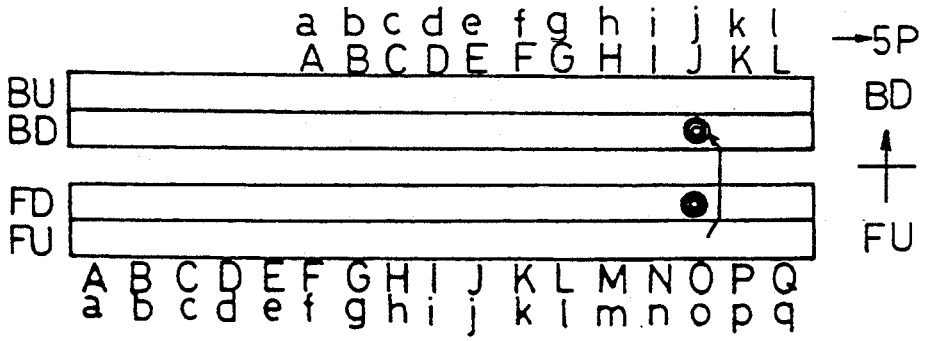
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33:
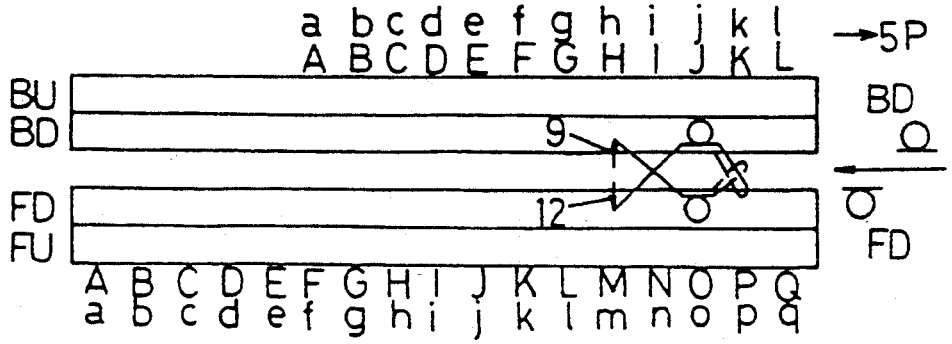
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34:
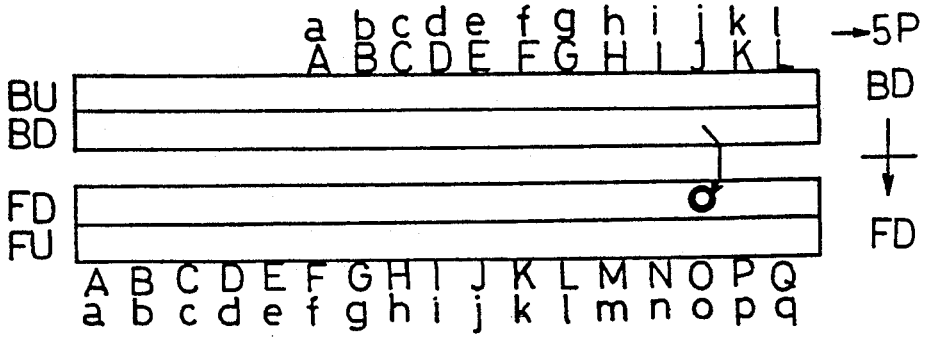
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35:
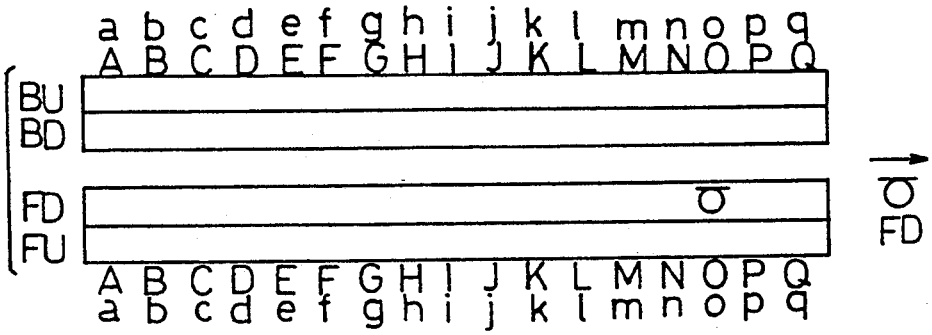
Figures 1, 5:
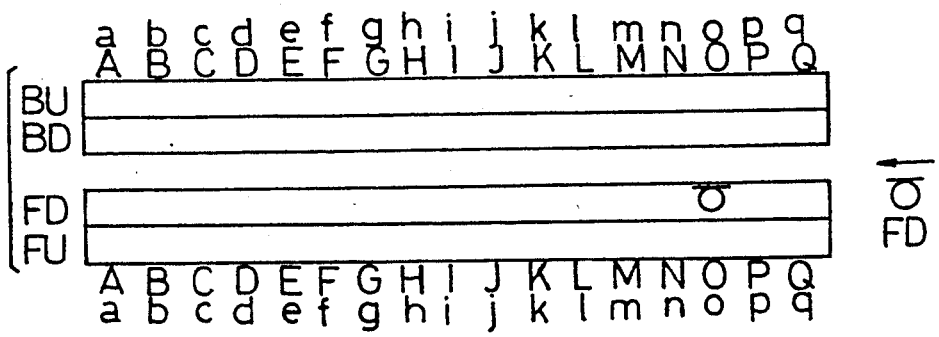
Figures 2, 5:
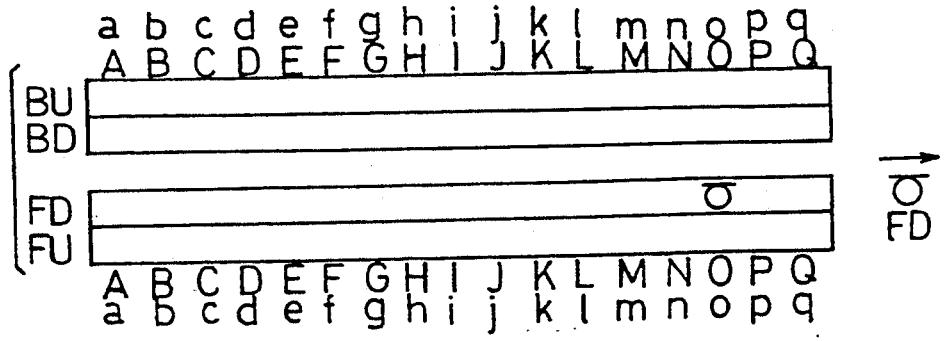
Figures 3, 5:
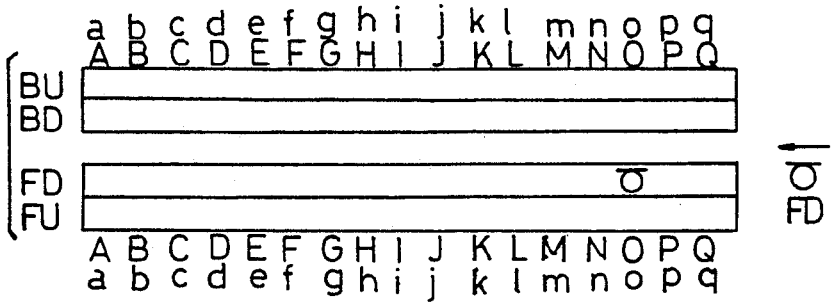
Figure 6:
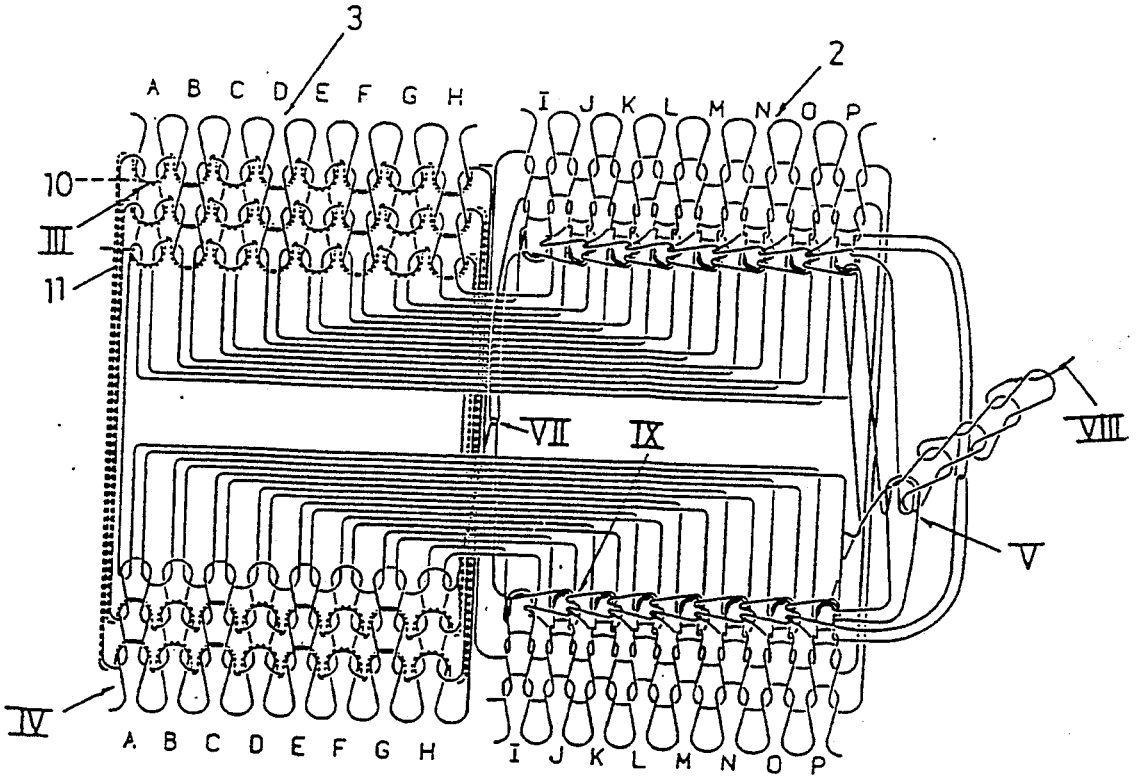
Figure 7:
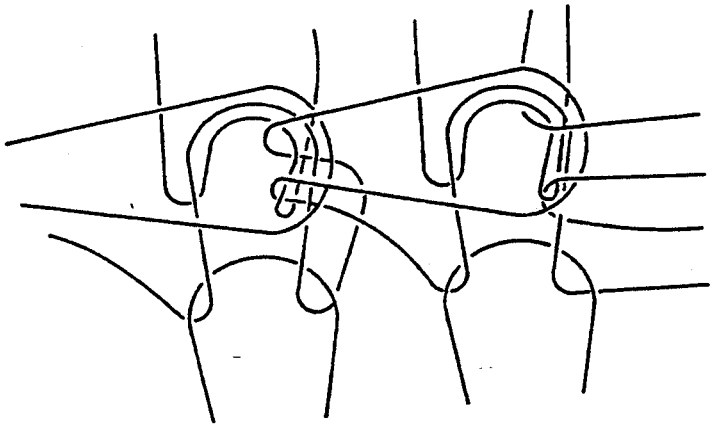

At the course shown in FIG. 4-5, the carriers 9 and 12 for feeding the yarn to the loops of the body and turtle neck portions 2,3 are displaced to the left side off the loops of the body portion 2 and the two, upper and lower, rear needle beds BD, BU are moved by one racking pitch from the position shown in FIG. 4-4 to the right or more specifically, to a position distanced 7 pitches leftward from their original position. When the loop on the knitting needle p of the upper rear needle bed BU is placed over the loop on the knitting needle I of the lower front needle bed FD, the right-end loop of the back piece of the turtle-neck portion 3 overlaps the left-end loop of the back piece of the body portion 2.

As shown in FIG. 4-6, after the two rear needle beds BD and BU are shifted to a position distanced 6 pitches leftward from their original position, i.e. displaced by one more racking pitch to the right from the position shown in FIG. 4-5, the loops on the knitting needles j and k of the upper front needle bed FU are transferred onto the knitting needles P and Q of the lower rear needle bed BD. Hence, the right-end loop of the front piece of the turtle-neck portion 3 becomes overlapping the left-end loop of the front piece of the body portion 2 on the knitting needle P.

At the course shown in FIG. 4-7, the two carriers 9 and 12 are moved from the position shown in FIG. 4-5 to the right and the yarn is fed through the knitting needles P and Q of the lower rear needle bed BD and the needles I and J of the lower front needle bed FD thus forming two loops. The two loops are thus coupled to each other at the left end as denoted by VII in FIG. 6, joining the turtle-neck portion 3 with the body portion 2 by one seam stitch.

As shown in FIG. 4-8, the two carriers 9 and 12 are then moved to the left and the loops on the knitting needles P and Q of the lower rear needle bed BD are transferred to the knitting needles j and k of the upper front needle bed FU.

At the course shown in FIG. 4-9, the two rear needle beds BD and BU are displaced to a position distanced 7 pitches leftward from their original position, i.e. moved by one racking pitch to the left from the position shown in FIG. 4-8, and the loop on the knitting needle j of the upper front needle bed FU is transferred onto the knitting needle Q of the lower rear needle bed BD. At the following course shown i FIG. 4-10, the two rear needle beds BD and BU are shifted to a position distanced 6 pitches leftward from their original position, i.e. returned by one racking pitch to the right from the position shown in FIG. 4-9, and the loop on the knitting needle k of the upper front needle bed FU is placed over the loop on the knitting needle Q of the lower rear needle bed BD.

At the course shown in FIG. 4-11, the two rear needle beds BD and BU are displaced to a position distanced 7 pitches leftward from their original position, i.e. moved by one racking pitch to the left from the position shown in FIG. 4-10, and the loops on the knitting needles I and J of the lower front needle bed FD are transferred onto the knitting needles p and q of the upper rear needle bed BU.

At the next course shown in FIG. 4-12, the two rear needle beds BD and BU are shifted to a position distanced 6 pitches leftward from their original position, i.e. returned by one racking pitch to the right from the position shown in FIG. 4-11, and the loop on the knitting needle p of the upper rear needle bed BU is transferred onto the knitting needle J of the lower front needle bed FD. Also, at the course shown in FIG. 13, the two rear needle beds BD and BU are displaced to a position distanced 7 pitches leftward from their original position, i.e. moved by one racking pitch to the left from the position shown in FIG. 4-12, and the loop on the knitting needle q of the upper rear needle bed BU is placed over the loop on the knitting needle J of the lower front needle bed FD.

At the course shown in FIG. 4-14, the two rear needle beds BD and BU are shifted to a position distanced 5 pitches leftward from their original position, i.e.

moved by two racking pitches to the right from the position shown in FIG. 4-13, and the loop on the knitting needle o of the upper rear needle bed BU is slipped to the knitting needle J of the lower front needle bed FD which now carries three loops together.

Then, the loop on the knitting needle O of the lower rear needle bed BD is transferred onto the knitting needle j of the upper front needle bed FU as shown in FIG. 4-15. At the course shown in FIG. 4-16, the two rear needle beds BD and BU are shifted to a position distanced 6 pitches left-ward from their original position, i.e. displaced by one more racking pitch to the right from the position shown in FIG. 4-15, and the loop on the knitting needle Q of the lower rear needle bed BD is transferred onto the knitting needle k of the upper front needle bed FU.

At the following course shown in FIG. 4-17, the two rear needle beds BD and BU are shifted to a position distanced 4 pitches leftward from their original position, i.e. displaced by two racking pitches to the right from the position shown in FIG. 4-16, and the loops on the knitting needles k and 1 of the upper front needle bed FU are transferred onto the knitting needles 0 and P of the lower rear needle bed BD. As the result, two loops are now on the knitting needle 0 of the lower rear needle bed BD. As shown in FIG. 4-18, after the two rear needle beds BD and BU are shifted to a position distanced 5 pitches leftward from their original position, i.e. displaced by one racking pitch to the left from the position shown in FIG. 4-17, the loop on the knitting needle j of the upper front needle bed FU is transferred onto the knitting needle 0 of the lower rear needle bed BD which now carries three loops together.

At the course shown in FIG. 4-19, the two rear needle beds BD and BU are shifted to a position distanced 4 pitches leftward from their original position, i.e. displaced by one racking pitch to the right from the position shown in FIG. 4-18, and the yarn is fed from the two carriers 9 and 12 to the knitting needles O and P of the lower rear needle bed BD and to the needles J and K of the lower front needle bed FD respectively. Accordingly, the binding off on "double knit stitches" is completed using the three loops and their adjacent loops, as denoted by IX in FIG. 6 and shown in FIG. 7.

The binding off on "double knit stitch" allows any tension exerted on the three loops to be dismissed through the adjacent loops. As the result, the finished knitted garment will withstand the assault of abnormal tension and will be prevented from rip-off and looseness of stitches. Also, the binding off on "single knit stitch" shown in FIG. 8, "triple knit stitch" shown in FIG. 9, or "multiple knit stitch" will be possible with equal success.

The binding off the three or two loops in the embodiment may appear on the right side as an accent of the pattern. On the contrary, when the arrangement of overlapping the loops of the body portion 2 and the turtle-neck portion 3 is inverted front side back, the bounded off stitches will appear on the wrong side or inside of the pullover 1.

After the course shown in FIG. 4-19 is finished, the body portion 2 and the turtle-neck portion are joined by knitting two stitches. The two stitches are thus accompanied with the seam stitch knitted at the course shown in FIG. 4-7 producing a total of three seam stitches.

At the course shown in FIG. 4-20, the two carriers 9 and 12 are moved to the left and the loops on the knitting needles 0 and P of the lower rear needle bed BD are transferred onto the knitting needles k and 1 of the upper front needle bed FU. Then, a series of the actions from FIG. 4-9 and FIG. 4-19 are repeated. At the course shown in FIG. 4-21, the loops of the turtle-neck portion 3 are joined with the loops of the body portion 2 by knitting two more stitches. There are now completed five seam stitches including the three stitches knitted throughout the actions up to the course shown in FIG. 4-19.

Then, at each of the courses shown in FIGS. 4-21 to 4-25, the turtle-neck portion 3 and the body portion 2 are joined through knitting two stitches after repeating the actions from FIG. 4-8 to 4-18. Accordingly, as shown in FIG. 4-25, two loops of the turtle-neck portion 3 are now on the knitting needles I and i of their respective lower and upper rear needle bed BD, BU and four loops of the body portion 2 are on the two knitting needles 0 and P of the lower front needle bed FD and the two knitting needles J and K of the lower rear needle bed BD so that six loops of the yarn remain unfinished.

At the course shown in FIG. 4-26, the loop on the knitting needle K of the lower rear needle bed BD, out of the six remaining loops, is transferred onto the knitting needle q of the upper front needle bed FU. At the succeeding course shown in FIG. 4-27, the two rear needle beds BD and BU are shifted to a position distanced 7 pitches rightward from their original position, i.e. displaced by one racking pitch to the right from the position shown in FIG. 4-26, and the loop on the knitting needle q of the upper front needle bed FU is transferred onto the knitting needle J of the lower rear needle BD which now carries two loops.

As shown in FIG. 4-28, the two rear needle beds BD and BU are then shifted to a position distanced 6 pitches rightward from their original position, i.e. returned by one racking pitch to the left from the position shown in FIG. 4-27, and the loop on the knitting needle P of the lower front needle bed FD is transferred onto the knitting needle j of the upper rear needle bed BU.

At the course shown in FIG. 4-29, the two rear needle beds BD and BU are shifted to a position distanced 5 pitches rightward from their original position, i.e. displaced by one racking pitch to the left from the position shown in FIG. 4-28, and the loop on the knitting needle j of the upper rear needle bed BU is transferred onto the knitting needle 0 of the lower front needle FD.

Also, at the course shown in FIG. 4-30, the two rear needle beds BD and BU are moved to a position distanced 6 pitches rightward from their original position, i.e. displaced by one racking pitch to the right from the position shown in FIG. 4-29, and the loop on the knitting needle i of the upper rear needle bed BU is transferred onto the knitting needle O of the lower front needle bed FD which now carries three loops.

At the following course shown in FIG. 4-31, the loop on the knitting needle I of the lower rear needle bed BD is transferred onto the knitting needle o of the upper front needle bed FU. Then, as shown in FIG. 4-32, the two rear needle beds BD and BU are shifted to a position distanced 5 pitches rightward from their original position, i.e. displaced by one racking pitch to the left from the position shown in FIG. 4-31, and the loop on the knitting needle o of the upper front needle bed FU is transferred onto the knitting needle J of the lower rear needle BD which now carries three loops, like O. Accordingly, the six remaining loops described in FIG. 4-26 are divided into two; three on the knitting needles O of the lower front needle bed FD and three on the knitting needles J of the lower rear needle bed BD.

At the course shown in FIG. 4-33, the yarn from the two carriers 9 and 12 located in the position shown in FIG. 4-25 is fed through the loops on the knitting needles 0 and J of their respective lower needle beds FD and BD thus forming two new loops which are interlocked each other at right end (as denoted by V in FIG. 6).

Then, one of the two loops on the knitting needle J of the lower rear needle bed BD is transferred to the knitting needle O of the lower front needle bed FD. The two loops are now on the same knitting needle 0, as shown in FIG. 4-34. At the course shown in FIG. 35, another loop is formed on the knitting needle O of the lower front needle bed FD and the procedure for joining the body 2 and the turtle-neck portion 3 together in a tubular form is completed. Succeedingly, a chain of loops are formed on the knitting needle 0 of the lower front needle bed FD to a predetermined length as shown in FIG. 5-1 to FIG. 5-3. After removed from the knitting needle O, the loops are bound off with its yarn end passed through the last loop, as denoted by VIII in FIG. 6, for preventing unraveling.

The finished tubular garment knitted by the foregoing procedure exhibits an invisible seam of joint loops between the separately knitted portions.

Although the method of knitting two adjoined tubular knit fabrics of the embodiment is carried out on the flat knitting machine provided with two, upper and lower, pairs of front and rear needle beds, it will with equal success be executed with a flat knitting machine having one pair of front and rear needle beds. Also, the present invention is not limited to joining a body portion and a turtle-neck portion of a garment nor a sleeve and a cuff, but will be applicable to joining other tubular knit fabrics.

Although the flat knitting machine used in the embodiment allows only the front needle beds to move, the rear needle beds may be movable exclusively or in combination with the front needle beds.

It is also understood that the tubular fabrics are knitted by any manner, e.g. flat, rib, or sack knitting.

The flat knitting machine in the embodiment has a maximum racking distance of 8 pitches in a direction (e.g. to the left). When the racking distance is increased, the transfer of knitted fabrics between the front and rear needle beds will be reduced in the number of times. Above all, the present invention can be embodied with the use of any flat knitting machine whichever provides racking movement.

As set forth above, the present invention allows tubular knit fabrics to be knitted simultaneously on one flat knitting machine and joined each other by weaving two corresponding edge rows of loops of their front or rear portions, which are facing each other in linear symmetry about the seam, without removal from the knitting needles of the machine. Accordingly, such a troublesome action of picking up each edge stitch for linking two separately knitted tubular fabrics, as in the prior art will be no more needed and thus, the productivity of knitted garment can sharply be increased.

Also, the drop-off of stitches which is common in the linking action is minimized and finished garments knitted by the method of the present invention will exhibit a higher and constant quality.

As compared with sewing two tubular knitted pieces with a sewing machine, the present invention produces a seam between two knitted pieces which is invisible and unchanged in thickness due to joining by knitting two edge rows of loops. Hence, the finished garments appear more smooth and fashionable this increasing the commercial value and also, will provide comfortability when being put on. Furthermore, two tubular knit fabrics are knitted and joined together on the same flat knitting machine, whereby an extra step of linking or sewing with a sewing machine, other than the knitting step, will be eliminated and the cost of production will be decreased.

We claim:

1. A method of knitting, on a flatbed knitting machine with at least a pair of front and rear needle beds, either or both of the needle beds being arranged for racking motion, two adjoining tubular knit fabrics, each having a front piece and a back piece coupled to each other, the steps comprising:

a front piece joining step comprising overlapping a loop of the front piece of one of the two tubular knit fabrics with a linear symmetric loop, about a boundary line, of the front piece of the other tubular fabric, forming a new front loop on the overlapped front loops, then, overlapping the new front loop with an additional loop from each of the front pieces arranged next to the first overlapped front loops, forming another new front loop on the second overlapped front loops, and overlapping said another new front loop with an additional loop arranged next to the another overlapped front loops;

a back piece joining step comprising overlapping a loop of the back piece of one of the two tubular knit fabrics with a linear symmetric loop, about a boundary line, of the back piece of the other tubular fabric, forming a new back loop on the overlapped back loops, then, overlapping the new back loop with an additional loop form each of the back pieces arranged next to the first overlapped back loops, forming another new back loop on the second overlapped back loops, and overlapping said another new back loop with an additional loop arranged next to the another overlapped back loops; and repeating the front piece joining step and the back piece joining step alternatively or continuously, depending on the number of loops to be joined, a predetermined number of times.

* * * * *